United States Patent [19]

Strakowski

[11] 4,350,152

[45] Sep. 21, 1982

[54] BACK MASSAGE BOARD

[76] Inventor: Joseph Strakowski, 112 Birch Way, San Rafael, Calif. 94903

[21] Appl. No.: 172,521

[22] Filed: Jul. 28, 1980

[51] Int. Cl.[3] ..... A61H 1/00

[52] U.S. Cl. ..... 128/24 R

[58] Field of Search ..... 128/24 A, 24 R, 24 B, 128/24.1, 24.2, 25 R, 78, 67, 68, 69, 33, 1 R; 272/1 R, 144, 120, 93, 94, 99, 70, 109, 111, 55, 56, 114, 146; 46/92, 94

[56] References Cited

U.S. PATENT DOCUMENTS

| | | | |
|---|---|---|---|
| 1,668,489 | 5/1928 | Band | 128/69 |
| 1,904,039 | 4/1933 | Bruder | 128/69 |
| 2,343,204 | 2/1944 | Paton | 272/144 |
| 2,612,158 | 9/1952 | Manley | 128/69 |
| 2,777,440 | 1/1957 | Baker | 128/69 |
| 2,803,461 | 8/1958 | Coplin | 272/1 R |
| 2,854,971 | 10/1958 | Williams | 128/69 |
| 3,672,360 | 6/1972 | Langhamme | 128/69 |
| 3,744,483 | 7/1973 | Picolin | 128/67 |
| 4,126,129 | 11/1978 | Rainbow | 128/69 |
| 4,206,558 | 6/1980 | Bivona | 272/70 |
| 4,210,322 | 7/1981 | Pritchard | 272/144 |

FOREIGN PATENT DOCUMENTS

| | | | |
|---|---|---|---|
| 1132190 | 3/1957 | France | 128/67 |

*Primary Examiner*—Richard C. Pinkham
*Assistant Examiner*—T. Brown
*Attorney, Agent, or Firm*—Melvin R. Stidham

[57] ABSTRACT

A massage board having a planar under surface to be supported on a floor or other flat surface and a convex upper surface, the board being of sufficient width and length to support the upper torso of a human adult while lying supine on the flat surface. While so supported on his back, the person may roll and twist over the convex surface to press against and massage sore muscles.

2 Claims, 2 Drawing Figures

BACK MASSAGE BOARD

BACKGROUND OF THE INVENTION

Back ailments are becoming increasingly common as a result of just normal, day to day activities, including lifting, bending, twisting and even sitting. Often such back aches may be greatly relieved or reduced in intensity through the medium of massage. Unfortunately, however, it often occurs that a person capable of giving an effective massage is not present, or in the vicinity, when the ailment occurs, and it is extremely difficult, if not impossible, for a person to reach back and massage his own back.

OBJECTS OF THE INVENTION

It is an object of this invention to provide a device capable of providing an effective self-massage.

It is a further object of this invention to provide a massage device which can be used effectively and stored conveniently when not in use.

It is a further object of this invention to provide a massage board which is effective in use and economical to manufacture.

Other objects and advantages of this invention will become apparent from the description to follow, particularly when read in conjunction with the accompanying drawing.

SUMMARY OF THE INVENTION

In carrying out this invention, I provide a board having a planar undersurface to be supported on any flat surface, such as a floor, bed, table or the like. The board is of a length and width to support the upper torso of an adult human and has a convex upper surface which curves upwards to a thickness of approximately 2 inches at the mid-point. A person can sit on the floor or other supporting surface and then recline back so that his back is supported on the convex upper surface of the massage board. In that position, one can roll, twist and contort his or her upper torso to cause the convex upper surface to rub and press against selected areas of the back.

DESCRIPTION OF A PREFERRED EMBODIMENT

Figure 1:
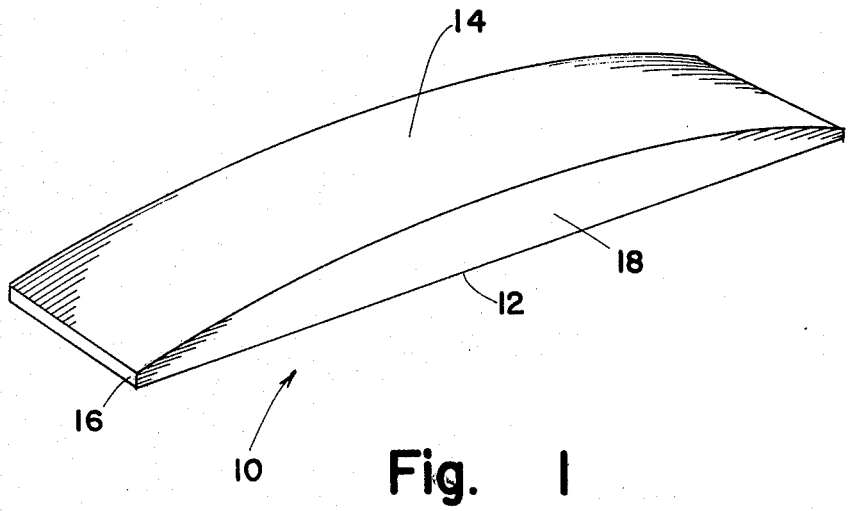
FIG. 1 is a view in perspective of the massage board of this invention.

Referring now to the drawing with greater particularity, the massage board 10 of this invention may be made of any suitable material, such as wood, plastic or the like, and includes a planar undersurface 12, which conditions it to be supported stably on the floor, table, bed or any other flat surface. The board is of a length and width adequate to support the upper torso of a person, while that person is reclining on the flat support surface. For example, a board of approximately 20 inches in length and 5 inches in width has worked quite satisfactorily for the purpose intended. The upper surface 14 is convex, curving upward from a thickness of $\frac{1}{4}$ inch or less at the opposite ends 16, to a thickness of approximately 2 inches at the mid point of the sides 18.

Figure 2:
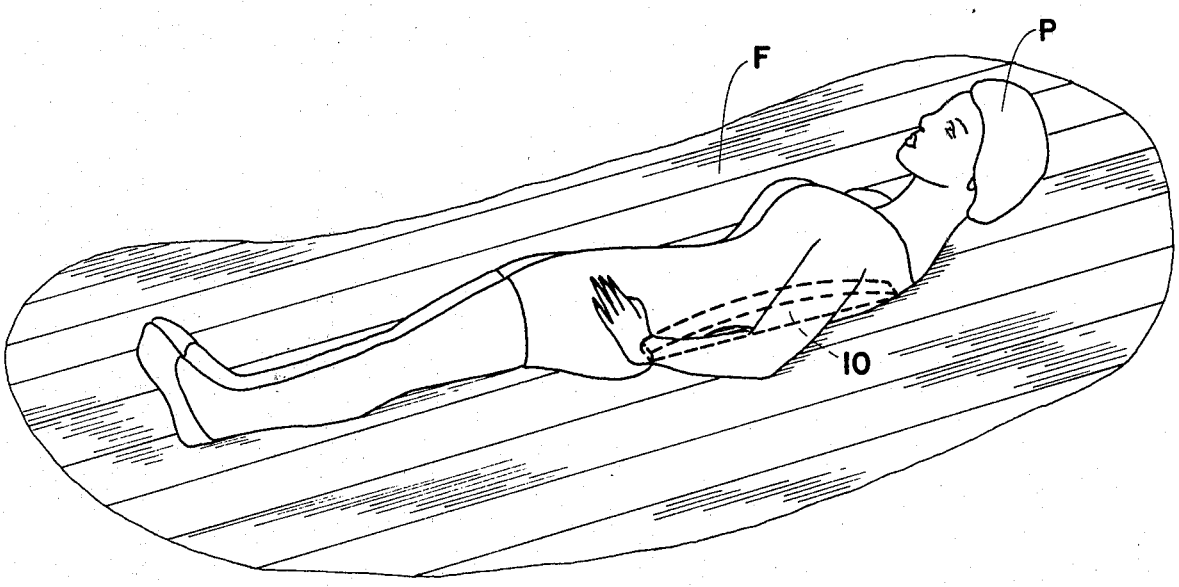
FIG. 2 is a view in perspective illustrating use of the invention.

In use, as illustrated in FIG. 2, the board 10 may be placed flat on any flat surface such as a floor F and a person P may sit on the floor with the board 10 disposed at the base of the spine. Then, rolling back, the person P may lie on his back supported jointly by the floor F and the board 10. While supine, such person may contort, twist and roll over the convex surface 14 of the board 10 and in that way give himself or herself a very effective massage. After lying atop of the board 10 the person may shift it so that the highest portion of the convex surface 14 is located at the point where the person is suffering maximum discomfort. The board may also be placed transversely across the back so that one can roll from side to side over the convex surface, again effecting a comforting massage.

It is apparent that one may massage other parts of his or her body by disposing the convex surface 14 where one is suffering some muscular discomfort.

While this invention has been described in conjunction with a preferred embodiment thereof, it is obvious that modifications and changes therein may be made by those skilled in the art without departing from the spirit and scope of this invention, as defined by claims appended hereto.

What is claimed as invention is:

1. A massage board having:

a planar under surface to be supported on a flat surface; and a convex smoothly curved upper surface of sufficient length and width to support the upper torso of human adult, said surface being generated by movement of a straight line along an arcuate path approaching said under surface at both ends so that said upper surface merges smoothly into said flat surface to enable one to be supported on said flat surface and roll back and forth over said upper surface without discomfort;

said board being between 18 inches and 30 inches in length and curving upward from less than $\frac{1}{2}$ inch in thickness at its ends to about 2 inches in thickness at its mid-point.

2. The massage board defined by claim 1 wherein: said board is about 5 inches in width.

* * * * *